US006219942B1

(12) United States Patent
Fini

(10) Patent No.: US 6,219,942 B1
(45) Date of Patent: Apr. 24, 2001

(54) METHOD FOR THE PRODUCTION OF FOOTWEAR AND THE FOOTWEAR PRODUCED ACCORDING TO THIS METHOD

(75) Inventor: Carlo Fini, Bologna (IT)

(73) Assignee: A. Testoni S.p.A., Bologna (IT)

( * ) Notice: Subject to any disclaimer, the term of this patent is extended or adjusted under 35 U.S.C. 154(b) by 0 days.

(21) Appl. No.: 09/288,455

(22) Filed: Apr. 8, 1999

Related U.S. Application Data

(63) Continuation-in-part of application No. 09/054,066, filed on Apr. 2, 1998, now abandoned, which is a continuation-in-part of application No. 08/741,137, filed on Oct. 29, 1996, now abandoned.

(51) Int. Cl.[7] ..... A43B 7/14; A43B 13/04; A43B 13/14

(52) U.S. Cl. ..... 36/93; 36/25 R; 36/132; 36/30 R; 36/154; 36/3 B; 361/224

(58) Field of Search ..... 36/88, 93, 25 R, 36/132, 30 R, 154, 163, 3 B; 361/223, 224

(56) References Cited

U.S. PATENT DOCUMENTS 2,273,563 * 2/1942 Delamere .
2,857,556 * 10/1958 Price .
3,274,442 * 9/1966 Peel .
3,544,841 * 12/1970 Peel .
3,730,169 * 5/1973 Fiber .
3,895,405 * 7/1975 Edwards .
4,231,169 * 11/1980 Toyama et al. .
4,520,580 * 6/1985 Brown .
4,694,589 * 9/1987 Sullivan .
4,727,452 * 2/1988 Brownlee .
4,727,661 * 3/1988 Kuhn .
4,782,605 * 11/1988 Chapnick .
5,123,180 * 6/1992 Nannig et al. .
5,146,698 * 9/1992 Tilles et al. .
5,611,153 * 3/1997 Fisher et al. .
5,653,047 * 8/1997 Franey .

* cited by examiner

*Primary Examiner*—Ted Kavanaugh
(74) *Attorney, Agent, or Firm*—Fay, Sharpe, Fagan, Minnich & McKee, LLP

(57) ABSTRACT

An article of footwear comprises a shoe in which the upper and base define a first total internal volume; molding of a standard inner sole made of a material which may be plastically thermoformed using a form, the inner sole having a second volume less than the first volume and, when inserted in a shoe, leaving a free volume, smaller than the total volume, inside the shoe; insertion of the standard inner sole in the shoe and fixing in place, so as to create a shoe-inner sole assembly in which, between the base and standard inner sole there is at least one space with an empty volume substantially corresponding to the difference between the first volume and the second volume; heating of the shoe-inner sole assembly made in this way to the preset temperature necessary for the thermoforming of the inner sole; insertion of a foot in the shoe, so as to shape the standard inner sole in the areas around the space according to the features of the sole of the foot.

7 Claims, 4 Drawing Sheets

FIG. 4
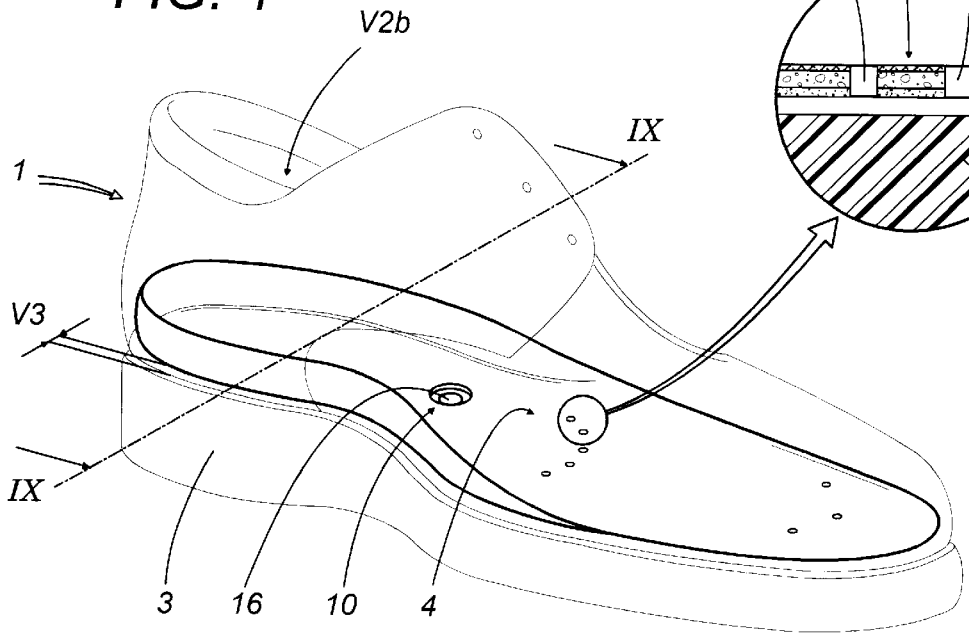
FIG. 5
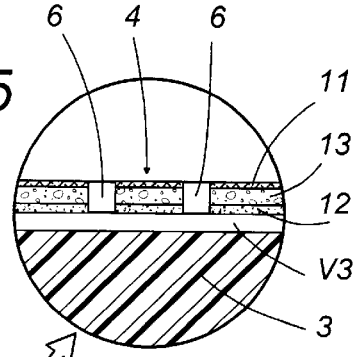
FIG. 7
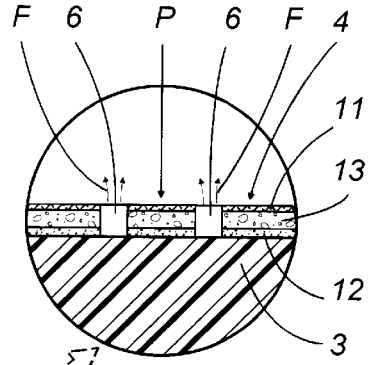
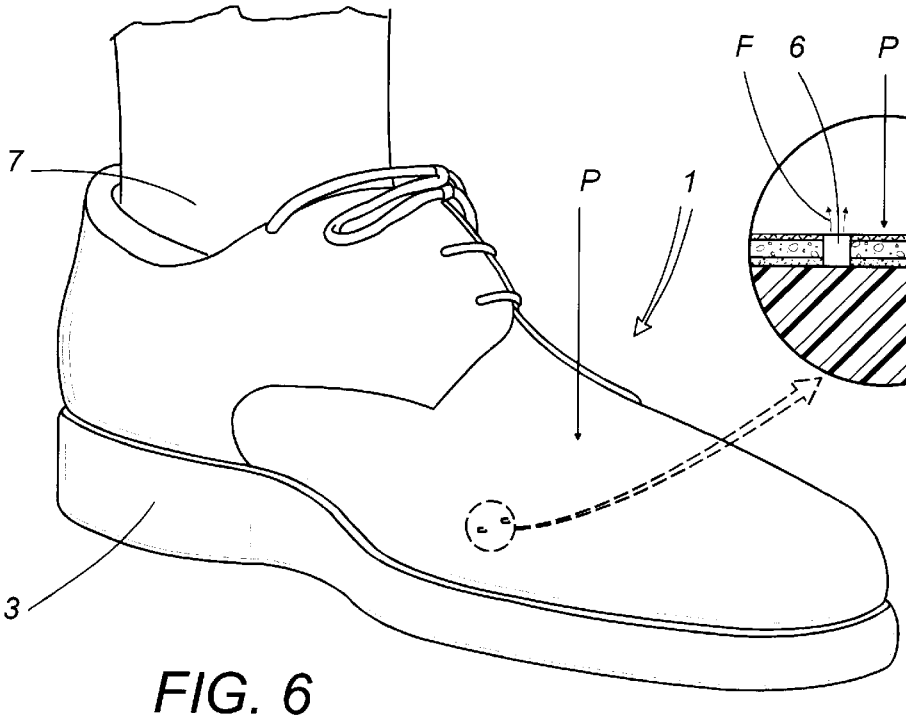
FIG. 6

METHOD FOR THE PRODUCTION OF FOOTWEAR AND THE FOOTWEAR PRODUCED ACCORDING TO THIS METHOD

This is a continuation-in-part of U.S. Ser. No. 09/054,066 filed on Apr. 2, 1998; which is a continuation-in-part of U.S. Ser. No. 08/741,137 filed on Oct. 29, 1996, both abandoned.

BACKGROUND OF THE INVENTION

The present invention relates to a method for the production of footwear and the footwear produced according to this method, particularly of the type which adapts to the shape of the wearer's foot.

The invention relates to footwear which offers a high degree of comfort without affecting the characteristic basic features, dimensions and appearance of conventional footwear for men, women and children.

Footwear is normally produced in a substantially standardized form, that is to say, having fitting features which adapt to well-defined average foot shapes, according to the size of foot for which the shoe is intended.

Obviously, such a footwear shape cannot be intended for all consumers; the problem arises from the fact that every individual has his or her own foot shape, which determines a unique distribution of body weight on the sole, weight which is taken directly by the inner sole of the shoe during movement or while standing. Since the inner sole is of standard shape and does not reflect the shape of the foot, the reaction of the shoe's sole and base to the wearer's weight is normally insufficient, reducing the degree of comfort and often preventing the wearer from appreciating the quality of his or her footwear.

A further problem which often affects footwear is poor aeration of the foot, causing an increase in sweating.

The aim of the present invention is to eliminate these disadvantages using a method for the production of footwear which allows the footwear to be shaped to the wearer's foot, in particular through the adaptation of the inner sole to the sole of the foot according to the way in which the sole of the foot rests on the inner sole.

SUMMARY OF THE INVENTION

The present invention, as described in the claims, provides a method for the production of footwear which envisages a base designed for contact with the ground, an upper which covers the top of the foot, and an inner sole which can be plastically formed for a given period of time at a given temperature and/or under a given body weight; the upper and the base define a total shoe volume, while the upper and the inner sole define a working volume whose value is less than the total volume; the presence of an empty volume between the inner sole and the base allows the shape of the shoe to be adapted to the shape of a foot which is inserted in it for a given period of time.

The present invention, therefore, allows the inner sole to be shaped to the foot, thanks to the formability of the inner sole.

Moreover, by making a set of holes in the inner sole, it is possible to obtain optimum aeration of the foot thanks to the circulation of air between the top surface of the inner sole and one or more spaces in the shoe between the bottom surface of the inner sole and the top of the base.

The present invention thus allows the wearer's body weight to be distributed over a significantly greater surface with respect to the standard surface offered by conventional footwear, reducing harmful stress on the foot and consequently tiring it less. Moreover, the distribution of body weight over a significantly greater surface, particularly in ladies' medium or high-heeled shoes, helps to prevent sprains caused by incorrect positioning of the foot at the heel and the presence of a notably reduced contact surface in this type of shoe.

This feature is emphasized by the use of an inner sole with sides which extend upwards so as to cover the sides of the foot in shoes produced according to this method.

An inner sole which substantially encloses the foot, that is to say, an inner sole which reflects the shape of the sole and sides of the foot, together with the presence of a volume of air between the inner sole and the top of the base, attenuates the shock produced by the wearer's movements, a shock which in conventional types of footwear is much more intense and is felt by the wearer with every step he or she takes.

BRIEF DESCRIPTION OF THE DRAWINGS

The technical features of the present invention, in accordance with the aforesaid aims, are clearly illustrated in the claims herein, and the advantages of the invention are more clearly shown in the detailed description below, with reference to the accompanying drawings which illustrate a preferred embodiments of the invention and in which:

FIG. 4 is a schematic view, with some parts transparent, of a shoe with an inner sole made in accordance with the present invention;

FIG. 5 is a detail of FIG. 4;

FIG. 6 is a schematic view of a shoe with an inner sole made in accordance with the present invention and worn on a foot;

FIG. 7 is a detail of FIG. 6;

DESCRIPTION OF THE PREFERRED EMBODIMENTS

With reference to the drawings listed above, the method disclosed may be used for the production of footwear. The accompanying drawings illustrate, by way of example, a man's lace-up shoe, a type of footwear which may be produced using the method disclosed. Obviously, the present invention applies to shoes which vary in shape and type, for example, ladies' and children's shoes, as well as low and high-heeled shoes.

The present invention relates to a plurality of embodiments of a shoe with inner sole of which two different embodiments are described here.

Figure 1:
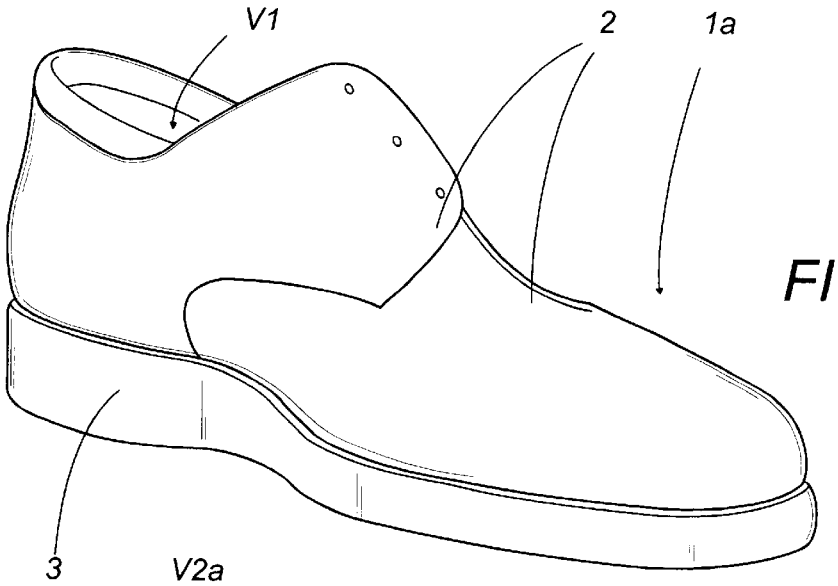
FIG. 1 is a schematic perspective view of a shoe without inner sole illustrating a step in the production of footwear in accordance with the present invention.

In both the embodiments described here, a shoe 1*a* without inner sole is initially created, as shown, for example, in FIG. 1. In particular, processes which allow the creation of a base 3 whose upper surface is preferably-completely smooth and even are used.

In practice, the shoe 1*a* comprises an upper 2, designed to cover the top of a foot 7, and the base 3, whose bottom, outside surface is designed to make contact with the ground (not illustrated).

Obviously, the base 3 need not consist of a single molding but may have several different plies (not illustrated).

A first volume V1 (see FIG. 1) is defined between the upper 2 and the base 3, this being the total volume or total internal volume of the shoe 1*a*.

The inner sole 4, which is missing from the shoe 1*a* and which must therefore be inserted at a later stage is formed in a standard manner from plastically formable material. The inner sole 4 may be deformed by heating it to a temperature T1 for a given period of time and/or by subjecting it to the stress created by the weight of the body for a given period of time T2.

Figure 2:
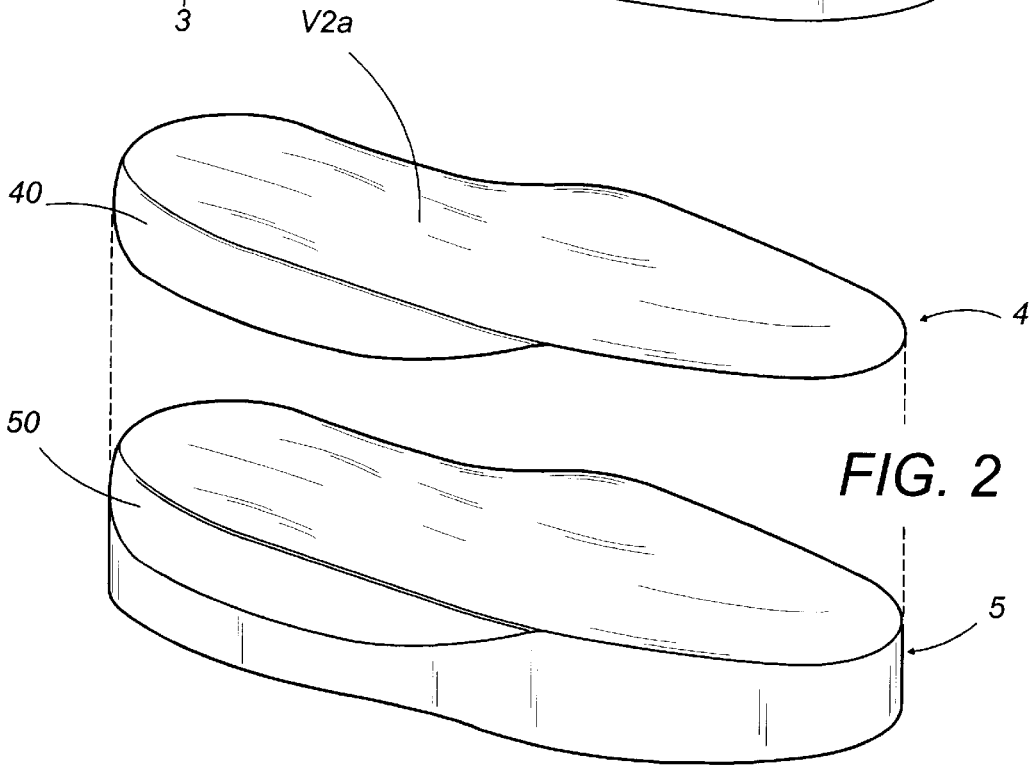
FIG. 2 is a perspective view showing, above, an inner sole illustrated upside down, and a form used for making the inner sole.

FIG. 2 shows that for the creation of the inner sole 4 an inner sole form or model 5 is used, having a contact surface for the formation of the inner sole 4. The inner sole 4 has a second volume V2*a* which is less than the aforementioned total internal volume V1 so that when the inner sole 4 is inserted into a shoe 1*a*, it defines free volume inside the shoe 1, hereafter called working volume V2*b* to allow the foot 7 to be inserted and which is less than the total volume V1. In other terms, a hypothetical molding from the form or mold 5 would define a volume smaller than that of the aforementioned shoe la without the inner sole 4.

Figure 3:
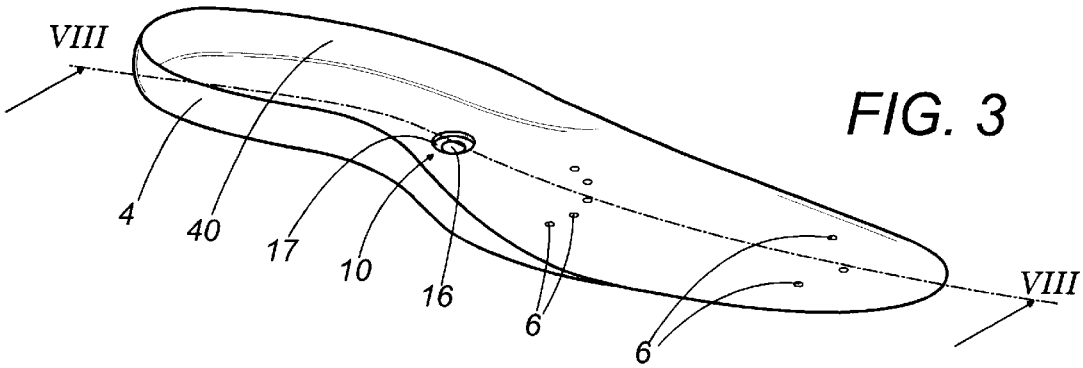
FIG. 3 is a perspective view of an embodiment of an inner sole made in accordance with the present invention.
Figure 9:
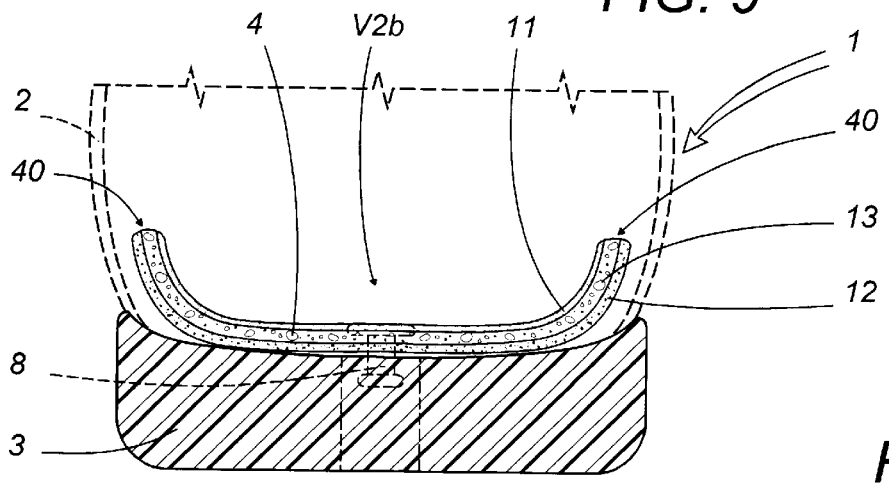
FIG. 9 is a cross section of the shoe along the line IX—IX of FIG. 4, with the inner sole inserted in it and with some parts of the shoe cut away in order to better illustrate others.

As shown by the drawings for the embodiment illustrated in FIGS. 2, 3 and 4, the inner sole 4 may have an edge 40 designed to enclose a corresponding section of the side of the foot 7. In other words, the inner sole 4 may partly enclose the lower side of the foot 7, in a similar way to the vertical sides of the shoe 1*a*. To obtain an inner sole 4 with this shape, the form 5 may have an upper portion or profile 50, whose shape matches the shape of the inner sole 4 to be made.

The inner sole 4 is then inserted in the shoe 1*a* and fixed in place so as to form a shoe—inner sole assembly 1 in which, thanks to the special shape of the inner sole 4, there is a space or empty volume V3 between the inner sole 4 on the one side and the upper surface of the base 3 and the lower part of the upper 2 of the shoe 1 on the other side.

Therefore, the empty volume V3 inside the shoe 1 is located below the inner sole 4. The empty volume V3 corresponds substantially to the difference between the total volume V1, on the one side, and the working volume V2*b* plus the second volume V2*a*, on the other side, that is to say, V3=V1−V2*b*−V2*a*. The third volume V3, thus defined, may be distributed over various zones of the inner sole 4, defining a plurality of spaces totaling V3 in volume.

With reference to the first embodiment, the inner sole 4 is artificially preheated inside the shoe 1*a* to form the shoe-inner sole assembly 1, up to a temperature T1 that makes at least a part of the inner sole 4 material thermoformable. Before the forming time has elapsed, the wearer's foot 7 is inserted into the shoe 1, as illustrated in FIG. 5, which shows both the foot and the lower part of the leg.

In this way, the inner sole 4 is shaped, at least in the zones which correspond with the space V3 (or the spaces totaling V3 in volume), according to the shape of the sole of the foot 7 and/or sections of the side of the foot, adapting the initially standard inner sole 4 to the features of the foot, in accordance with the distribution of weight P on the surface of the inner sole 4 and any contact between the sides of the foot 7 and the edge 40 of the inner sole 4.

As mentioned above, the present invention also has other embodiments. For example, the second embodiment is distinguished from the first embodiment just described in that the inner sole 4 is not artificially preheated.

In the second embodiment, the inner sole 4 is placed in the shoe 1*a* at ambient temperature. The foot 7 is then inserted into the shoe 1 and, thanks to natural body heat, warms the inner sole 4 to the aforementioned given temperature T1. The latter, which depends on the material or part of the material from which the inner sole 4 is made, is obviously lower than the temperature used for the first embodiment. The inner sole 4, which is standard before being used in the shoe 1, is thus plastically formed by the foot 7 after the aforementioned given period of time T2 at least at the areas of the space V3 according to the surface of at least the sole of the foot 7 so as to adapt the standard inner sole 4 to the individual geometrical features of the foot 7, transforming the initially standard inner sole 4 into a customized inner sole 4.

Figure 8:
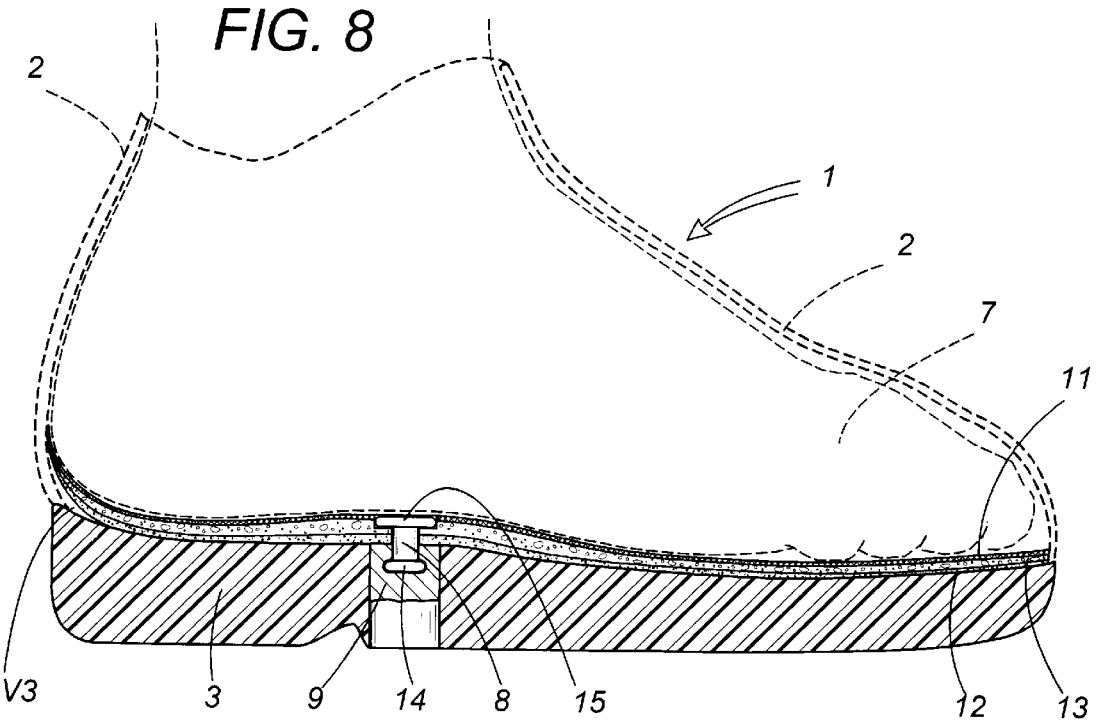
FIG. 8 is a longitudinal section of the shoe along the line VIII—VIII of FIG. 4, with the inner sole inserted in it and with some parts of the shoe cut away in order to better illustrate others.

As shown in FIGS. 5, 7 and 8, the inner sole 4 consists preferably of three plies of different materials . The upper ply 11, which is designed to come into contact with the foot 7, is made from a first elastically deformable material, while the bottom ply 12 is made from a more rigid backing material that can be elastically formed when heated to a given temperature T1 and that is designed to come into contact with the base 3 and with the bottom of the upper 2. The middle ply 13 is made from a soft, formable material designed to become plasticized under the weight of the body after a given period of time.

The top ply may be made from leather, activated carbon, a material which absorbs odors or gives off a fragrance, a warming or a cooling material or even a material permeable to air. The bottom ply 12 may be made of cloth with thermosetting resins and the middle ply 13 is made from foam which is deformed under the weight of the body after a given period of time.

As regards the variety of possible materials for both the embodiments described above, the top ply 11 of the inner sole 4 can be made from specific materials suitable for different environmental conditions, for example the seasons, and/or special requirements of individual wearers of the shoe 1.

In winter, for example, the top ply 11 can be made from heat conductive material while, in summer, the material must allow the feet to breathe to allow maximum freshness.

Again with reference to both the embodiments described above, it is possible to make a set of holes 6 in the standard inner sole 4, so that, once the inner sole 4 has been shaped to the foot 7, air is allowed to flow between the top and bottom of the inner sole 4, that is to say, between one or more residual portions of the space V3 and the resulting part of the working volume V2*b*.

This air flow is better illustrated in the details of FIGS. 4 and 5, which illustrate respectively a configuration of the shoe 1 in the absence, and in the presence of the wearer's weight P, with the corresponding air flow F from one side of the inner sole 4 to the other. Air flows from one side of the inner sole 4 to the other mainly as the wearer walks, when the foot 7 is prone-supine.

Alternatively, instead of making the holes 6, the inner sole 4 could be made from a material which is permeable to air. The holes 6 are preferably made before fixing the inner sole 4 to the shoe 1.

Figure 10:
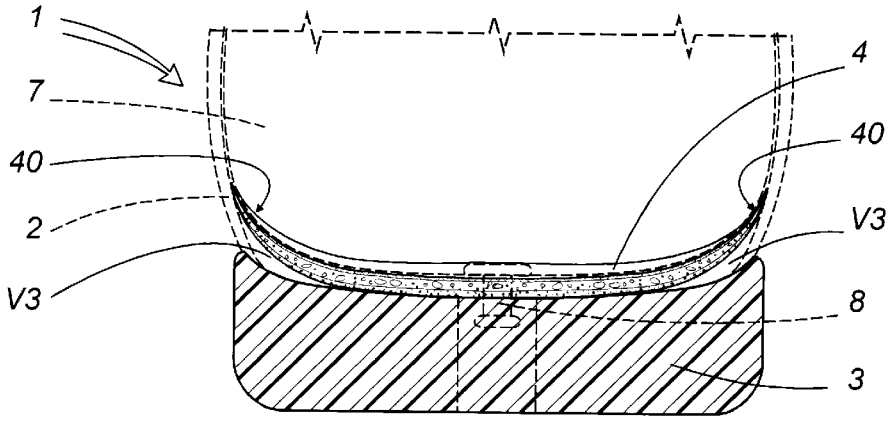
FIG. 10 is a cross section of the shoe along the line IX—IX of FIG. 4, with the foot inserted in the shoe with the inner sole and with some parts cut away in order to better illustrate others.

In both the embodiments described above, the inner sole 4 can be fixed to the base 3. The inner sole 4 is fixed preferably in the central area 10 of it where the foot 7 comes only into slight contact with the inner sole 4. The distance between the fixing point and the heel of the shoe 1 is preferably but not necessarily around 6 cm. According to the present invention, the plies 11, 12 and 13 may have a variable thickness in the lengthways and/or crossways direction, as shown, for example, in FIGS. 8 and 10.

According to the present invention, the inner sole 4 has a through hole 16 forming a suitable seating 17 to permanently accommodate the top 15 of a nail 8 or other fastening element such as a screw, for example. The nail 8 is preferably solidly incorporated in the seating 17 so that its top end 15 is aligned with the upper surface of the inner sole 4 and remains in direct contact with the foot 7. The other end 14 of the nail 8 protrudes freely from the bottom surface of the inner sole 4 and is designed to be securely fixed in a suitable seating 9 in the base 3. The free end 14 is fixed in the seating 9 for example by snap fastening, preferably detachable. The seating 9 is exactly coaxially aligned with the seating 17 formed by the through hole 16 to enable the inner sole 4 to be correctly positioned and fixed in the shoe 1 using the nail 8.

Since the shape of the front edge of the inner sole 4 exactly matches the shape of the front inside portion of the shoe 1*a*, a single nail 8 is usually sufficient to fasten the inner sole 4 to the base 3 accurately, quickly and securely. Two or more fastening elements may, however, be used to assemble the inner sole 4 and the base 3 more effectively.

Moreover, the nail 8 and the seating 9 are preferably made of metal, for example, copper, so that it can discharge static electricity from the shoe 1 to the ground. For this reason, as illustrated in FIG. 8, the seating 9 in the base 3 is designed to come into direct contact with the ground or floor PC (illustrated in FIG. 11).

Figure 11:
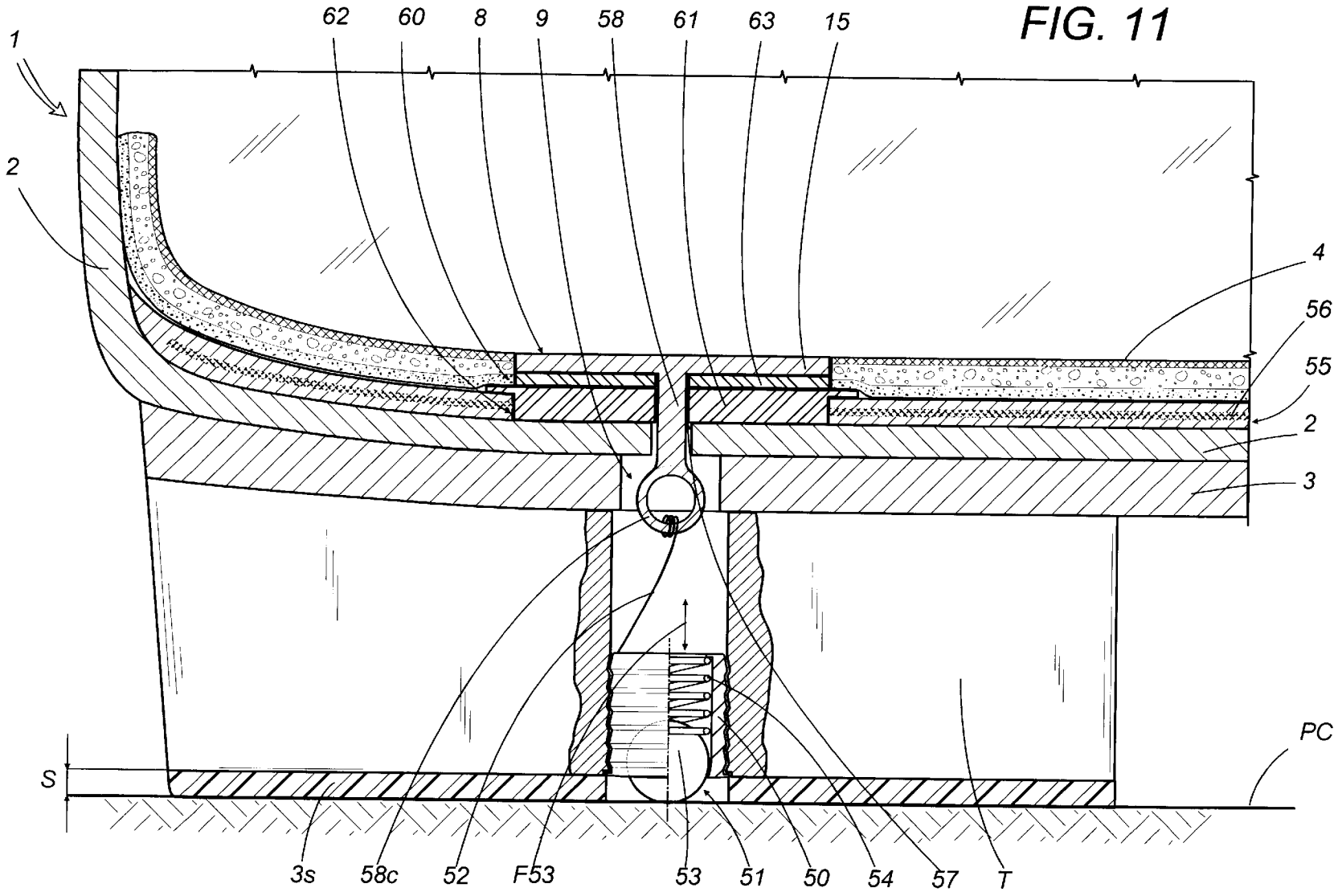
FIG. 11 shows an enlarged detail view, in cross-section and with some parts cut away in order to better illustrate others, of the shoe shown in the illustrations listed above.

In this regard, in the embodiment shown in FIG. 11, the base or sole 3 has a seating 9 which goes right through it to the floor PC. A tubular insert 50 is securely fixed inside the seating 9, the insert having an outer surface that is, preferably rough or threaded so it may be secured axially inside the seating 9. For example, in FIG. 11, the tubular insert 50, made of a conductive metal material, is positioned in the seating 9 made in the part of the base 3 that corresponds to the heel T of the shoe 1.

This tubular element 50 has, on the one side, means of contact 51 with the floor PC and means 52 for electrically connecting the tubular insert 50 with the positioning and/or fastening element 8 of the inner sole 4. In this way it is possible to create an electric connection which can discharge any static electricity to the floor PC.

In further detail, the contact means 51 consist of a ball 53, made of a conductive metal material, a portion of which protrudes from the lower end of the tubular insert 50 and is in continuous contact with the floor PC. The ball 53 is acted upon by spring means 54 (consisting of a helical spring) placed on the inside of the tubular insert 50, positioned between the ball and the upper end of the insert and designed to keep the ball 53 in contact with the floor PC depending on the contact thickness S of the base 3 on the floor thanks to the vertical movement by which the ball 53 adapts (see arrow F53). The working thickness S may preferably be that defined by a heel piece 3s.

The electrical connection means 52 consist of a metal wire conductor (preferably in copper) connected at one end, to the tubular insert 50 and running along the entire seating 9 of the base 3 to reach the positioning and/or fastening element 8 to which the wire is fastened.

The numeral 55 indicates a lining element or second inner sole for stiffening the backing of the upper 2 located between this and the inner sole 4 (illustrated by the broken line in FIG. 11). This lining element 55 has a metal core 56 for stiffening and a through hole 57, with a precise size that is coaxial to the seating 9 allowing the positioning and/or fastening element 8 to pass through it.

In this particular case, the positioning and/or fastening element 8 may comprise a head 15 which allows the inner sole 4 to be positioned in the shoe 1, and a fastening stem 58, which can be used to press fit the element in the measured hole 57 in the lining element 55. The stem 58 has a closed ring 58*c* designed to connect the wire 52.

As can also be seen in FIG. 11, between the head 15 of the positioning element 8 and the lining element 55, there are flexible means 60 which form a cushion designed to allow the positioning element 8 to slide axially according to the thickness of the inner sole 4 in such a way as to keep the inner sole 4 and the head 15 of the positioning element 8 in the same plane regardless of plastic deformation due to the wear and tear of the inner sole.

In a preferred but non-restrictive embodiment, the cushioning means 60 are flexible and consist of a spring bush 61 coupled in a corresponding seating 62 made in the lining element 55 which protrudes above it, and a flexible disc 63 made of the same type of material as the bush and connected to the bottom part of the head 15 of the positioning element 8.

Therefore, this embodiment allows the inner sole to be exactly positioned in the shoe thanks to the element 8 which has a head with a large diameter which does not affect the comfort of the shoe (thanks to the adaptable cushioning), with the consequent advantage of being able to make a simple measured hole in the inner sole 4 to achieve this position.

Furthermore, there is also the possibility of obtaining a surer and more effective discharge of the static electricity to the ground thanks to the ball and spring assembly. The internal and external appearance of the shoe is not altered and, the head of the fastening element may be used, given the dimensions, as a surface on which to stamp the label of the footwear. This surface, together with the copper wire and the ball and spring assembly allows good contact between the foot and the floor as well as greater resistance to wear and tear.

The advantage of using a nail 8 or similar fastening element to fix the inner sole 4 to the base 3 in a well-defined, limited area 10 is that the upper surface of the inner sole 4 remains smooth and, at the same time, air is not prevented from passing from the bottom to the top of the inner sole 4.

It must be stressed that this advantage is lost if the inner sole 4 is glued to the base 3 completely or even only in the areas to be used for the passage of air. Compared to the solution using a nail 8 or similar element, gluing also has the disadvantage that the inner sole 4 cannot easily be removed from the base 3.

Using a nail 8 or similar element in a well-defined, limited area 10 has the additional advantage that it allows the passage of air also inside the empty volume V3 between different empty areas connected to each other, that is, between one or more residual portions of the empty volume V3 and the resulting part of the working volume V2*b*. Moreover, the holes 6, which are preferably through holes, allow air to pass to and from the top and the bottom of the inner sole 4 at least at the spaces V3 between the inner sole 4 and the upper surface of the base 3 of the shoe 1. This air flow is facilitated by the fact that the inner sole 4 is fixed to the base 3 at a single point, as described above, or at two or more, nevertheless localized, points.

In both embodiments, the inner sole 4 in a shoe 1, allows improved contact between the foot 7 and the inner sole 4 and increases the effective contact surface at least at the back and central portions of the foot 7 thanks to the free adaptation of the inner sole 4 to any shape of foot 7. This adaptation is made possible by the presence of the empty volume V3 between the inner sole 4 on the one side and the base 3 and the lower part of the upper 2 on the other.

The advantage of this is that the inner sole 4 is "tailored" to the individual foot 7 while the shoe 1 is being worn in by the foot 7 itself.

This characteristic has several benefits for the wearer, for example, the improvement of his or her posture. The fact that the foot 7 is supported also by the raised edges 40 helps to give greater stability since the foot 7 wearing the shoe 1 can easily assume its ideal position in the latter. This allows the wearer's body to be better balanced.

Moreover, the inner sole 4, which remains permanently in contact with the foot 7, permits relative movement of the latter in the area of the empty volume V3 where the inner sole 4 can be elastically deformed so that the wearer can assume a natural position that is not negatively influenced by the shoe.

The inner sole 4 also stimulates the foot at points that remained passive with conventional shoe types. The inner sole 4 made according to the present invention, favors nerve stimulation and blood circulation, particularly in the arch of the foot, since the permanent contact between the inner sole 4 and the points of the foot 7 which, on the contrary, were left free by conventional inner soles, has the effect of massaging the sole of the foot.

The empty volume V3, whose size always depends on the individual adaptation of the inner sole 4 to the foot 7, prevents the inner sole 4 from pressing excessively on the passive parts of the foot 7.

That makes for an improved individual fit of the shoe 1 on the foot 7 which has beneficial effects by allowing the foot 7 greater freedom of movement, without tiring it and without straining the wearer's ankle.

The present invention is also suitable for ladies' high-heeled shoes where the inner sole 4 accommodates the foot 7 in the shoe in a manner that provides stability without altering the wearer's posture.

The new inner sole 4, in both the embodiments described above, prevents the foot 7 from tiring and provides an efficacious and lasting feeling of comfort, allowing the shoe 1 to be worn even for extended periods of time.

According to the present invention, therefore, the inner sole 4 has a basic, standard shape to start with and is then individually shaped into an inner sole 4 that can be perfectly adapted to the foot 7 and that is capable of providing the above mentioned advantages.

If the inner sole 4 is fixed to the base 3 by removable means, that is to say, by a nail 8 or a similar removable element, it may after being worn for a certain length of time, be changed with a new inner sole 4 having better and/or different characteristics. In this case, the inner sole should preferably be removed and refitted at the point of sale and not by individual end users.

A shoe made according to the present invention, therefore, includes a base 3 designed to make contact with the ground, an upper 2 to cover the top of the foot, and an inner sole 4 made of a material which can be plastically formed.

In accordance with the present invention, the inner sole 4 can be made from a material known under the trade name EVALUX ART.555XE. The properties of this material are as follows: t,0220

The upper 2 and base 3 can, obviously, vary in shape, according to the aesthetic and functional requirements of the shoe.

The invention described can be subject to modifications and variations without thereby departing from the scope of the inventive concept. Moreover, all the details of the invention may be substituted by technically equivalent elements.

What is claim is:

1. A shoe comprising a base designed to make contact with the ground, an upper to cover the top of the foot, and an inner sole made partly of a first material which can be plastically thermoformed when heated to a given temperature for a given period of time and partly of a second material that can be formed under the weight of a body after a given period of time; the upper and the base forming a total internal shoe volume; the inner sole having a second volume that is smaller than the total internal volume so as to allow the formation, between the base and the inner sole, of at least one space forming a complementary, variable empty volume which combined with the second volume and a working volume forms the total internal volume; and where the first material and the second material of the inner sole are designed to be adapted and shaped to the individual shape of the foot when the latter is placed in the shoe;

wherein the inner sole has at least one through hole that forms a seating, the inner sole being designed to be positioned in the shoe in such a way that the seating in the inner sole is coaxially aligned with a seating in the base so as to enable the insertion of a fastening element into both seatings to fix the inner sole to the base;

wherein the seating in the base goes right through the base, a tubular insert being securely fixed inside the seating in the base and having, on one side, means of contact with a floor, and, on another side, means for electrically connecting the tubular insert with the fastening element so that static electricity can be discharged to the floor; and wherein the contact means consist of a ball made of conductive metal material, a portion of which protrudes from the lower end of the tubular insert and is in contact with the floor; the ball being acted upon by spring means placed on the inside of the tubular insert positioned between the ball and the upper end of the insert and being designed to keep the ball in contact with the floor depending on the contact thickness of the base on the floor.

2. A shoe comprising a base designed to make contact with the ground, an upper to cover the top of the foot, and an inner sole made partly of a first material which can be plastically thermoformed when heated to a given temperature for a given period of time and partly of a second material that can be formed under the weight of a body after a given period of time; the upper and the base forming a total internal shoe volume; the inner sole having a second volume that is smaller than the total internal volume so as to allow the formation, between the base and the inner sole, of at least one space forming a complementary, variable empty volume which combined with the second volume and a working volume forms the total internal volume; and where the first material and the second material of the inner sole are designed to be adapted and shaped to the individual shape of the foot when the latter is placed in the shoe;

wherein the inner sole has at least one through hole that forms a seating, the inner sole being designed to be positioned in the shoe in such a way that the seating in the inner sole is coaxially aligned with a seating in the base so as to enable the insertion of a fastening element into both seatings to fix the inner sole to the base;

wherein the seating in the base goes right through the base, a tubular insert being securely fixed inside the seating in the base and having, on one side, means of contact with a floor, and, on another side, means for electrically connecting the tubular insert with the fastening element so that static electricity can be discharged to the floor; and wherein the electrical connection means consist of a metal wire conductor connected, at one end, to the tubular insert running along the entire seating in the base to reach the fastening element to which the wire is fastened.

3. The shoe according to claim 2, wherein the positioning and/or fastening element comprises a head which allows the inner sole to be positioned and a fastening stem of precise size which can be used to press fit the element in the lining element; the stem having a closed ring to which the wire is connected.

4. The shoe according to claim 2, wherein, between the head of the positioning element and the lining element, there are flexible means which form a cushion designed to allow the positioning element to slide axially according to the thickness of the inner sole in such a way as to keep the inner sole and the head of the positioning element in the same plane.

5. The shoe according to claim 4, wherein the cushioning means are flexible and consist of a spring bush coupled in a corresponding seating made in the lining element which protrudes above it.

6. The shoe according to claim 4, wherein the cushioning means are flexible and consist of a spring bush coupled in a corresponding seating made in the lining element which protrudes above it and a flexible disc connected to the bottom part of the head of the positioning element.

7. A shoe comprising a base designed to make contact with the ground, an upper to cover the top of the foot, and an inner sole made partly of a first material which can be plastically thermoformed when heated to a given temperature for a given period of time and partly of a second material that can be formed under the weight of a body after a given period of time; the upper and the base forming a total internal shoe volume; the inner sole having a second volume that is smaller than the total internal volume so as to allow the formation, between the base and the inner sole, of at least one space forming a complementary, variable empty volume which combined with the second volume and a working volume forms the total internal volume; and where the first material and the second material of the inner sole are designed to be adapted and shaped to the individual shape of the foot when the latter is placed in the shoe;

wherein the inner sole has at least one through hole that forms a seating, the inner sole being designed to be positioned in the shoe in such a way that the seating in the inner sole is coaxially aligned with a seating in the base so as to enable the insertion of a fastening element into both seatings to fix the inner sole to the base;

wherein the seating in the base goes right through the base, a tubular insert being securely fixed inside the seating in the base and having, on one side, means of contact with a floor, and, on another side, means for electrically connecting the tubular insert with the fastening element so that static electricity can be discharged to the floor; and wherein a lining element defining a second inner sole for stiffening a backing of the upper is located between the backing of the upper and the inner sole; the lining element having a metal core and a through hole coaxial to the seating in the inner sole so as to allow the fastening element to pass therethrough.

* * * * *